US006009685A

United States Patent [19]

Dahlberg

[11] Patent Number: 6,009,685

[45] Date of Patent: Jan. 4, 2000

[54] METHOD AND DEVICE FOR ISOLATED FILLING OF A CONTAINER

[76] Inventor: Karl Magnus Dahlberg, Linderudveien 26, N-0594 Oslo, Norway

[21] Appl. No.: 09/091,216

[22] PCT Filed: Dec. 18, 1996

[86] PCT No.: PCT/NO96/00291

§ 371 Date: Jul. 17, 1998

§ 102(e) Date: Jul. 17, 1998

[87] PCT Pub. No.: WO97/22542

PCT Pub. Date: Jun. 26, 1997

[30] Foreign Application Priority Data

Dec. 18, 1995 [NO] Norway ..... 955133

[51] Int. Cl.[7] ..... B65B 39/00

[52] U.S. Cl. ..... 53/175; 53/449; 493/100

[58] Field of Search ..... 53/175, 449; 493/100, 493/101

[56] References Cited

U.S. PATENT DOCUMENTS

| | | |
|---|---|---|
| 3,377,766 | 4/1968 | Nelson . |
| 3,590,888 | 7/1971 | Coleman . |
| 3,975,795 | 8/1976 | Kupcikevicius et al. . |
| 5,005,726 | 4/1991 | Robbins . |
| 5,154,308 | 10/1992 | Larson . |
| 5,277,015 | 1/1994 | Brown et al. . |

FOREIGN PATENT DOCUMENTS

| | | |
|---|---|---|
| 26 60 519 | 4/1983 | Germany . |
| WO 90/10579 | 9/1990 | WIPO . |
| WO 94/19242 | 9/1994 | WIPO . |
| WO 94/19255 | 9/1994 | WIPO . |

*Primary Examiner*—Daniel B. Moon
*Attorney, Agent, or Firm*—Young & Thompson

[57] ABSTRACT

A device in the form of a funnel (1) and comprising a holder (2) and a folded bag (36), for filling a container (8) such as an oil barrel or a standard container such as a type IBC, in such a manner that the bag forms an insulated lining between the product, e.g. oil, with which the container has to be filled, and the actual container. The device further comprises a lining (24) for mounting in the container's filling opening (10), and in the lining there is mounted a bottom member (22) which is surrounded by the bottom of the bag (36), the latter and the bottom member being pushed into the bag's main part from the top and down through the bag's opening (23). When the container is filled the funnel (1) is first screwed by means of the lining (24) into the filling opening (10), and a supply pipe (14) with enclosed push rod (18) is pushed down through the holder (2), passing the bag (36) in an evacuated state down to the bottom of the container. Special design of the bag (36), axial slots (16) at the bottom of the supply pipe (14) and guide elements (46, 46') ensure that the bag is expanded in the correct manner during filling. At the bottom of the push rod (18) there is a closing/push piston (20) which closes the supply pipe during the final phase of filling. After filling the lining (24) is kept screwed into the container and is closed by a lid (19), until the container is empty and a new funnel has to be mounted thereon.

13 Claims, 6 Drawing Sheets

METHOD AND DEVICE FOR ISOLATED FILLING OF A CONTAINER

Figure 1A:
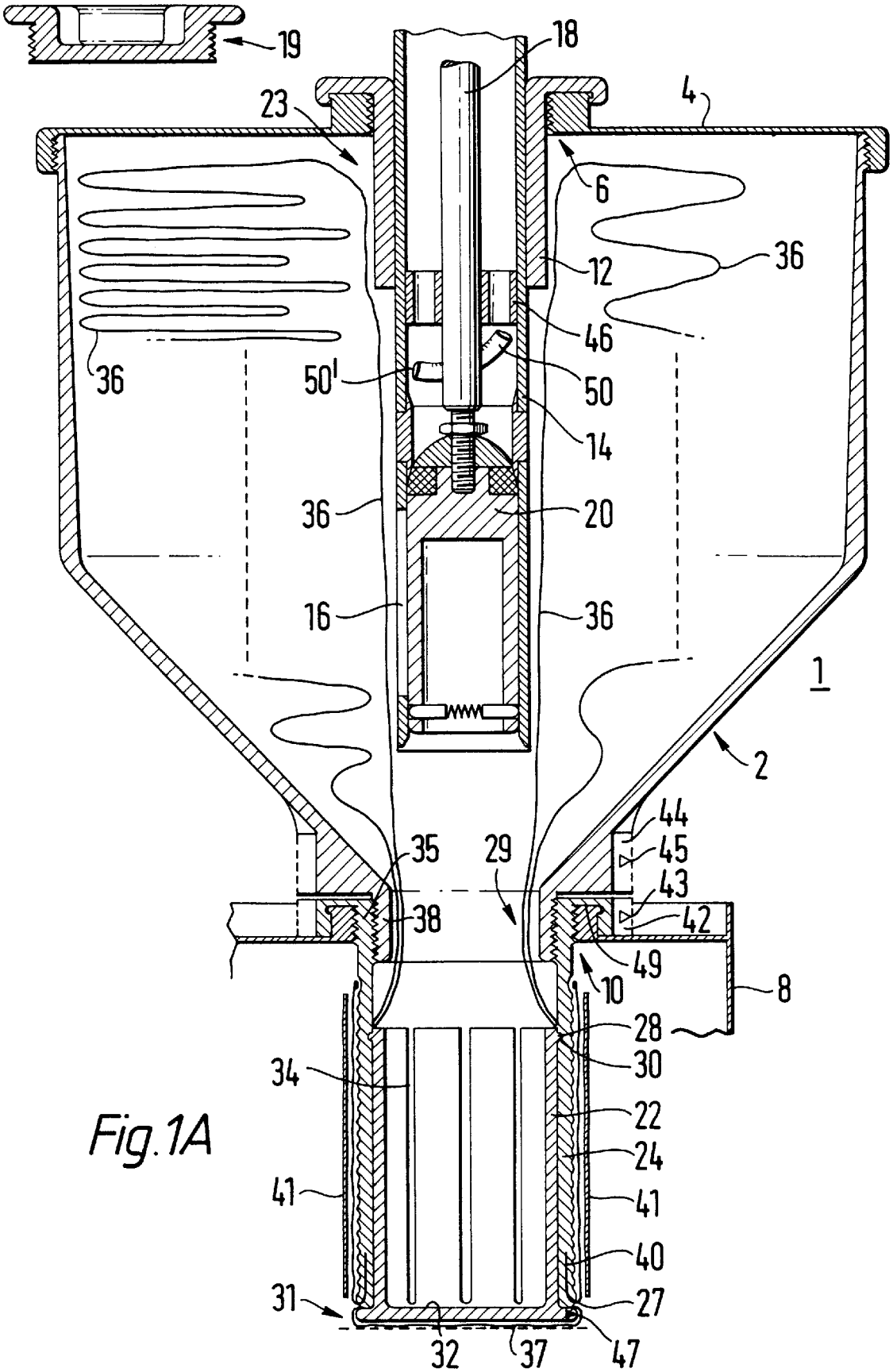

The invention concerns a device for insulated filling of a container, which device comprises a holder with a folded bag with one or two openings and arranged for insertion into the container and in an expanded state forms a lining therein and where the container further has at least one closing device in order to keep the container and the bag closed and a supply pipe for filling the bag with fluid or material after it has been inserted in the container, thus enabling the container to be filled without the fluid or the material coming into contact with the inside walls of the container.

In this context the term "insulated" means that the material with which the container is filled should not touch the inside of the container, but should be kept inside a bag which is inserted first and which is described in technical terms as a "liner". Even though the invention can be employed in all types of containers with an open internal cavity, it has been especially developed in connection with this kind of "lined" filling of oil barrels or so-called Euro-containers (IBC international bulk container), forming in principle a funnel with an associated bag.

For the sake of simplicity, therefore, in the description of a typical design, even in its complete form with insertion elements, etc., the entire device will be called a "funnel", while the container will be called a "barrel" or "oil barrel". The device or the funnel, however, is also suitable for lined and insulated filling of other containers, including everything from small bottles up to very large ship's tanks.

The funnel is adapted to present day and future requirements with regard to resource-saving and environmentally friendly distribution, it will be cost competitive in the field of systems which arc based on resource-saving reuse and/or recycling, and it is particularly suited for adaptation to already existing filling and distribution systems for fluid or material, first and foremost oil. In this respect the invention offers considerable advantages over the hitherto known solutions.

The concept of the invention further develops and combines two technical fields, viz. packaging solutions with a liner for use in a resource-saving deposit and return system, and storage and distribution of paint, chemicals, waste oil or fresh oil in large handling units such as oil barrels.

The state of the art for the first of these technical fields is represented by U.S. Pat. No. 5,242,085 published in September 1993, and the international application WO94/19242 with priorities from February and August 1993, while the second technical field in the patent literature is represented by WO-A-88/08401, FI 55814, GB 1 392 603 and EP 0 462 175.

We shall briefly illustrate the problems in these technical fields, taking the latter first:

During normal transport and handling, cylindrical packaging units such as oil barrels and other units with polygonal cross sections made of metal or plastic have a limited durability, partly due to damage which can easily be incurred and partly as a result of external attacks of corrosion. This may cause leakages to occur, giving rise to pollution. Internal corrosion can also be a problem when metal oil barrels are used for corrosive liquids. Finally, oil barrels with a filling opening only at the top are difficult to empty completely, which also contributes to pollution, and in many cases when they are reused, up to several litres of remaining liquid have to be first removed by a cleaning process which first of all is undesirable for several reasons and moreover can be difficult to implement quickly and effectively.

A solution which protects the inside of the barrel and simplifies the cleaning process or renders it superfluous may be to provide an impermeable bag or liner whose shape and volume are adapted to the inside of the barrel. According to WO-A-88/08401 it is proposed that such a liner should be attached to a cylindrical neck section and the entire unit screwed into the oil barrel's threaded bung-hole. However, the bag's neck section protrudes fairly high above the rim of the barrel, thus preventing stacking.

In FI 55814 there is disclosed a variation in which the liner's neck section is firmly clamped between the barrel's bung-hole and a deformable plastic ring which is hammered into it. When the bag is installed, an internally threaded sleeve is forced into the plastic ring and sealed by a plug. The drawback is that the mechanism is cumbersome to use, and it has been shown that the bag is easily worn out in the transition to the securing ring.

In GB 1 392 603 an attempt is made to solve the problem for barrels which have a lid which can be lifted (e.g. barrels intended for lubricating grease or viscous material), a large plastic lining with a self-supporting neck being provided, but the mechanism consequently cannot be used together with oil barrels.

The common feature of these three patent publications is that they do not specify sufficiently good practical solutions for to-day's situation and consequently also fail to cover the requirement of the field for a satisfactory method of furnishing a barrel with a liner.

In EP 0 462 175 with the title "A device for use in storage of a material, such as a liquid, in metal barrels" the liner principle is followed up with an apparently attractive combination of the strength of a steel barrel and the protective effect of a plastic bag, but on closer inspection this device too has a number of disadvantages. A liner is basically packed in a combined transport and installation package which is used to pass the bag down into the barrel through its bung-hole. The bag is amply dimensioned in order to prevent stresses in the inlet area and requires to be inflated with compressed air in a preliminary operation before filling. The attachment area for the bag differs from the prior art in that it has a rigid, threaded neck section formed in one piece with the main part of the bag, and in that the neck section's internal threads have a smaller diameter than the external threads for screwing into the bung-hole, both the internal and external threads extending over the same area.

Even though a device of this kind is surprisingly simple to use and cheap to manufacture, the preparation of a barrel for filling will be relatively time-consuming, viz. in the order of at least 2–4 minutes, since the bag and the installation package have to be carefully pushed down into the bung-hole manually. Moreover, after these have been pushed in, but before filling. the bag has to be inflated with compressed air for industrial use (oil particles, etc.) and in the air from, e.g., a hair dryer (dust, hair, organic particles, etc.) the application will be limited to waste oil, paint remains and other items where there are no requirements with regard to cleanness, which is also specified as the primary area of application.

Generally speaking, to have an open bag will be contrary to certain regulations concerning production supervision and quality assurance, especially for applications in the food industry. It will also be a disadvantage with regard to the working environment to first fill the barrel and its liner with air when they have to be filled with a liquid which may emit gas or fumes (e.g. petrol fumes or volatile oil fumes). The fact is that these will escape together with the first air injected and spread to the environment or have to be collected in a special manner.

The use of steel barrels is described in more detail in the report "Packaging and circulation", ISBN 91-620-4299-8. The report applies to Swedish conditions, but can also approximately agree with the situation in Norway and other countries. It states that it is whole barrels with a volume of 208 l which still virtually dominate the market and further that in Sweden there are from 1–3 million empty barrels in circulation at any time. Solutions which entail the recycling of several barrels by economizing on internal cleaning or eliminating the risk of transferring remaining material from previous use, therefore have very great economical potential. Furthermore, it is pointed out that for the sake of improving environmental effects and optimizing metallurgic yield, it will eventually be required that scrap iron from empty barrels should maintain a high quality and above all not contain polluting remains nor oils and other organic materials which can contribute towards an increase in dioxin formation in the melting temperature (circa 1900° C.) of an electrosteel furnace.

Environmental considerations have further led to a desire to stop the depositing of empty oil barrels and replace it with special destruction.

The first-mentioned technical field concerning deposit and return packaging borders on oil barrel technology, and particularly the idea of a liner in an enveloping container is common to both. For a long time attempts have been made to exploit this concept on a large scale, but it is considered that it is only with the patent publications NO 930639 and 933073 and their continuation in WO94/19242 that it represents a practical concept for industrial use, when account is taken both of modern requirements for recycling, minimal use of resources and rational automatic mass production. WO94/19242 concerns a scalable container device for fluid or material, with a container with a wide neck and a lid. Inside the lid there is a sealed and folded liner and it is not until it is filled in a filling plant that it is opened at the top and inserted into the container. The requirements placed on the actual container are not particularly stringent, either with regard to impermeability or cleanness, these properties being taken care of by the liner. The same patent publication is also concerned with a follow-up of a container device lid of this type in order to make it suitable to be guided, both alone and mounted on a container, especially in the form of a bottle, both in returned bottle dispensers and during transport and other handling.

The object of the present invention is to follow up the prior art and provide a device which does not have the disadvantages which arc outlined above. especially for the technical field involving filling of oil barrels, but in general expands the scope of application of packaging technology, i.e. all types of containers with open, internal cavities. Particular emphasis should be placed on the fact that the bag which is intended to serve as a lining for an external container should be kept evacuated to the greatest possible extent thereby ensuring that it does not contain air which has to be vented during the filling of, e.g., oil. On the other hand the invention does not cover the actual container which may be, e.g., a standard oil barrel, a Eurocontainer or a tank, but is limited to the actual device called a "funnel", the liner in the form of a bag, and associated elements for rapid and precise insertion into the correct position in the container. The invention further calls for a suitable filling machine or a modification of a conventional machine of this type, and it includes a method for insulated filling of containers.

The object of the invention is achieved with a device and a method which are characterized by the features which are presented in the patent claims. Particularly advantageous features are presented in the subclaims.

Even though the following embodiment describes a design with a funnel-shaped container, with the use of a push rod as a guide means, with a piston body at the end, it should be pointed out that this only illustrates one design and that such elements can be varied within the scope of the invention. For example, the holder may be of a different shape to that which is illustrated, and the shape will also be dependent on the diameter and shape of the insertion hole. The body for guiding the bottom member with the end of the bag down to the bottom may also be designed in different ways, especially in those cases where a completely airtight device is not necessary. The embodiment described below should therefore be regarded only as an example of how the invention can be designed.

Figure 1B:
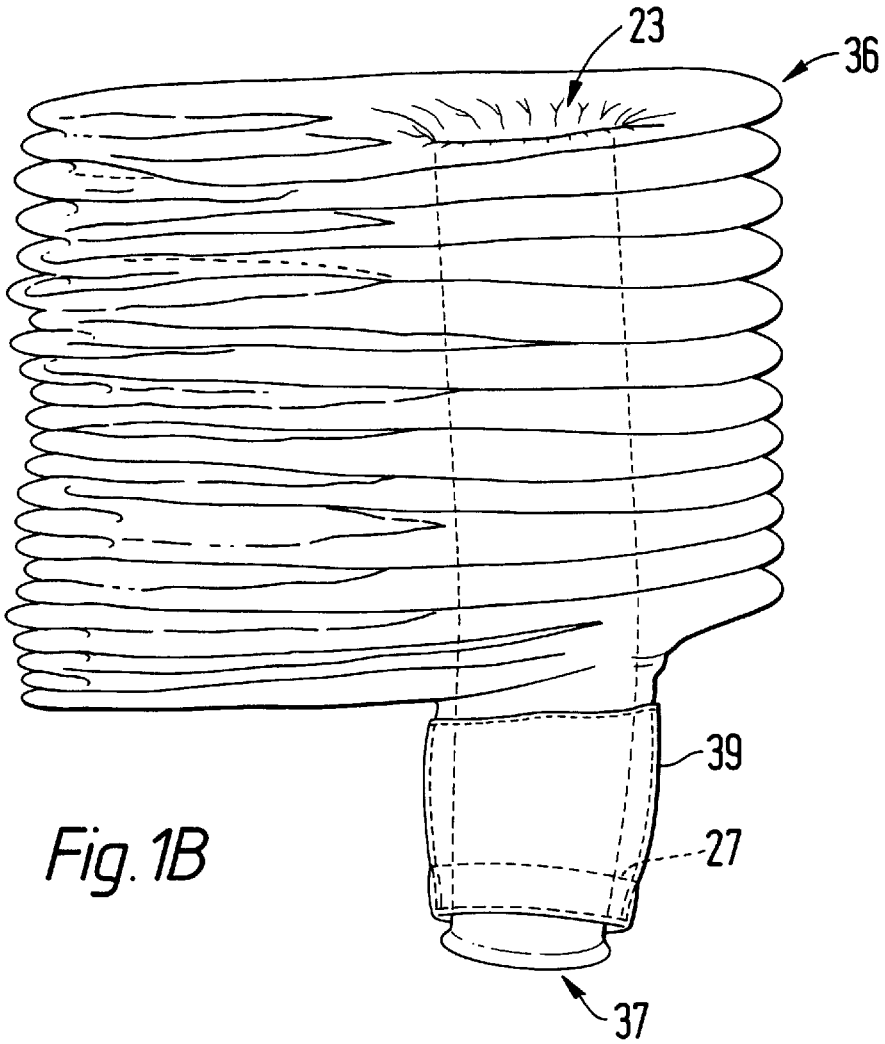
Figure 1C:
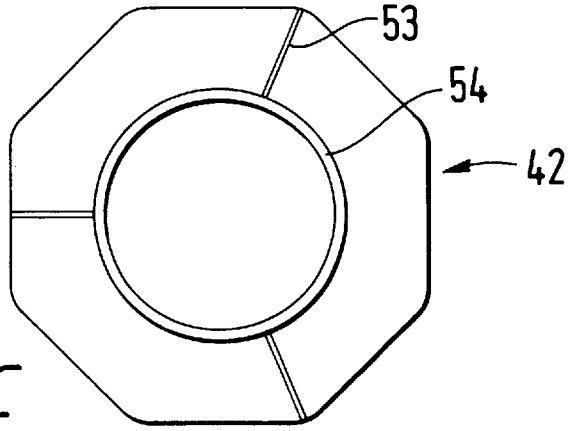
Figure 2:
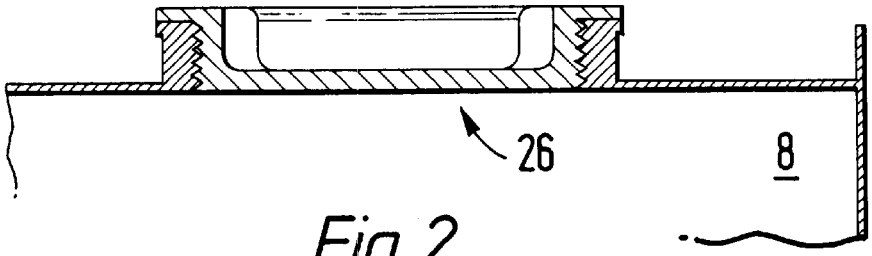
Figure 3:
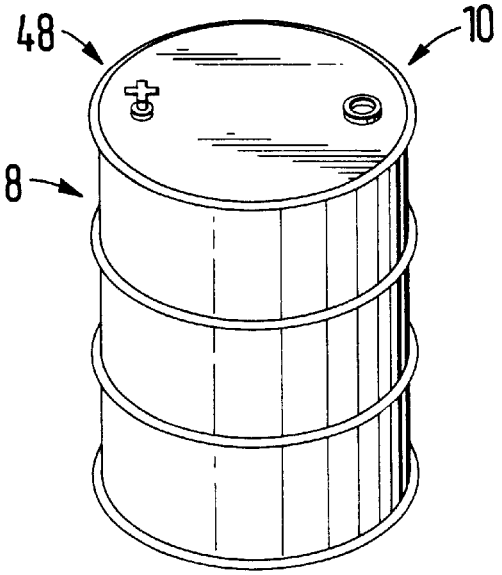
Figure 4:
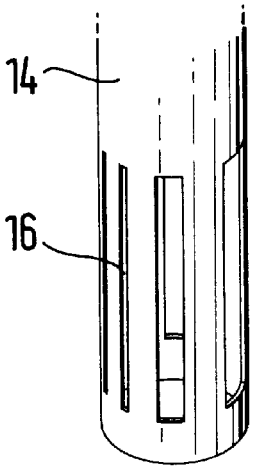
Figure 5:
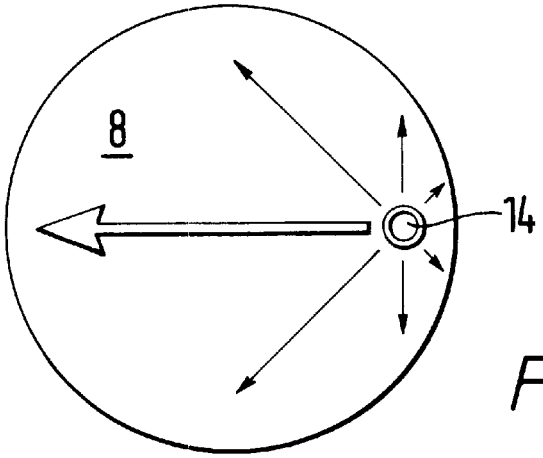
Figure 6:
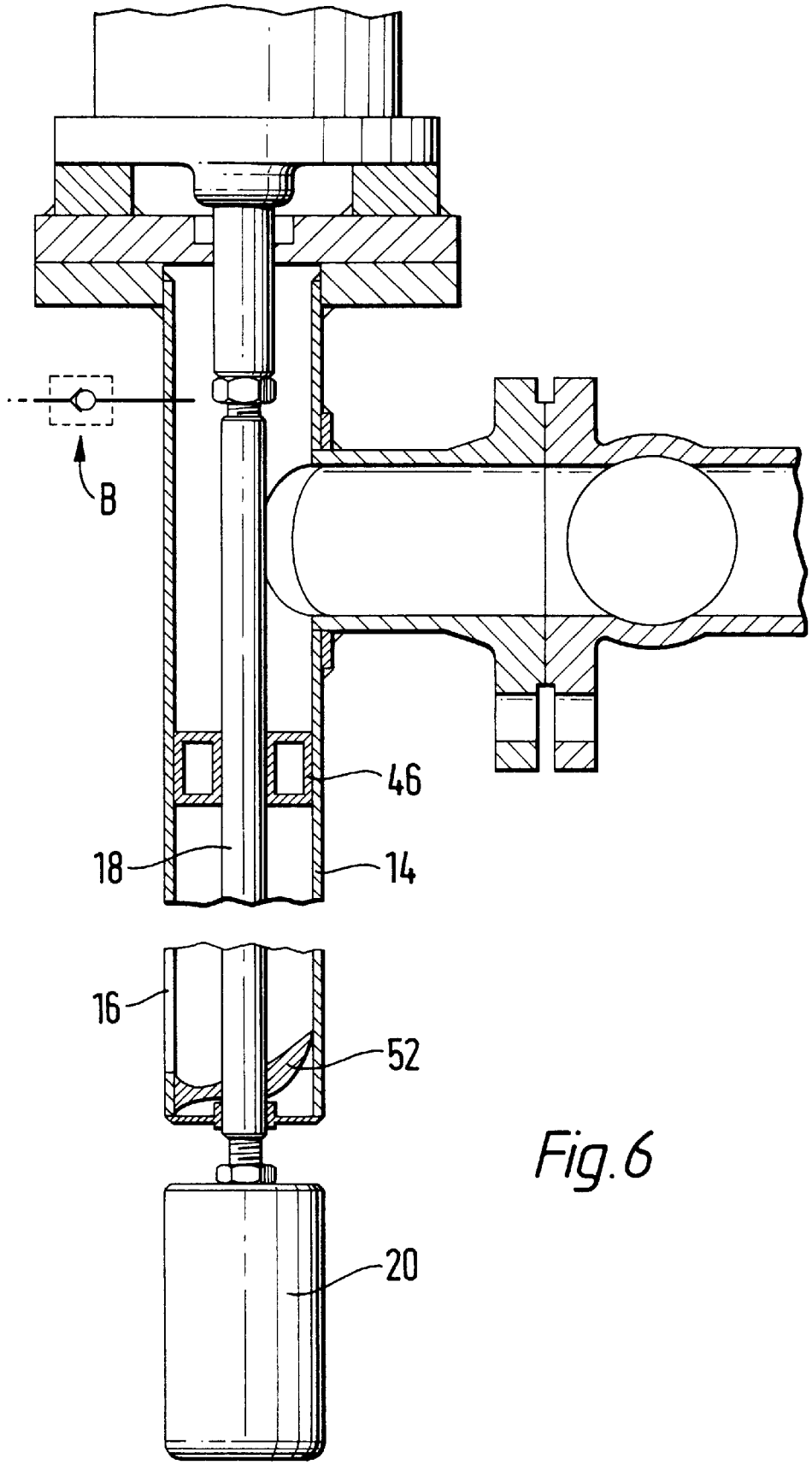
Figure 7:
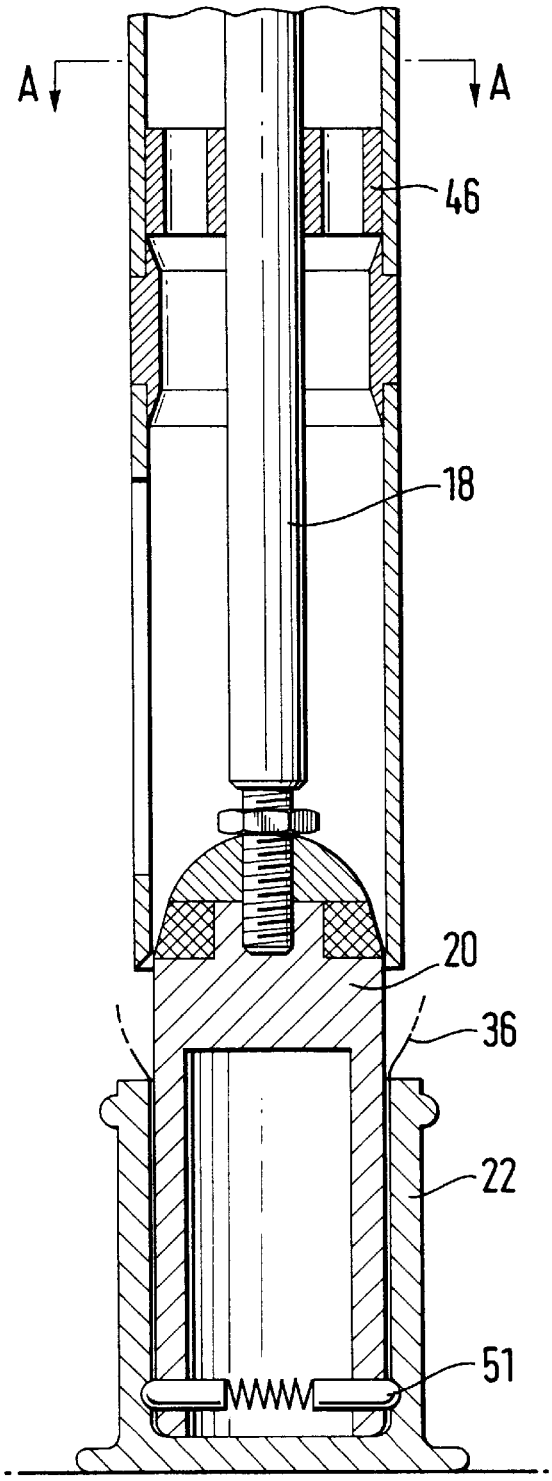
Figure 8:
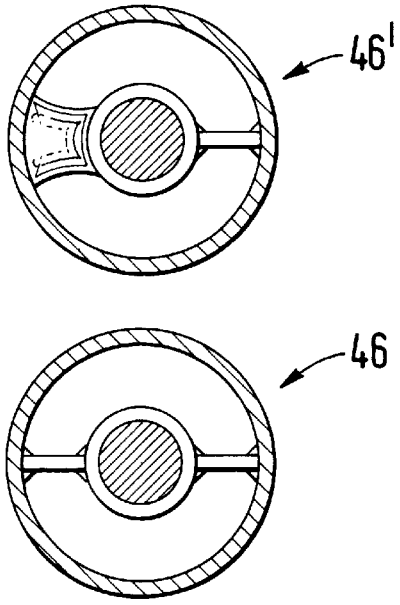
Figure 9:
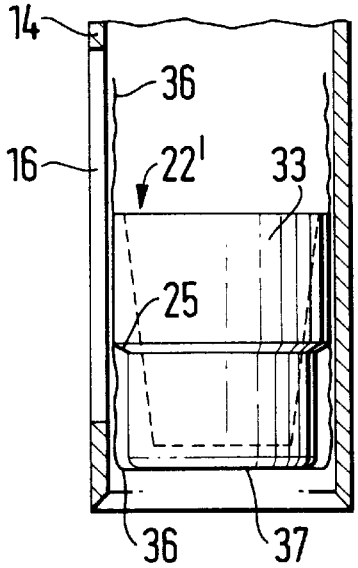
Figure 10A:
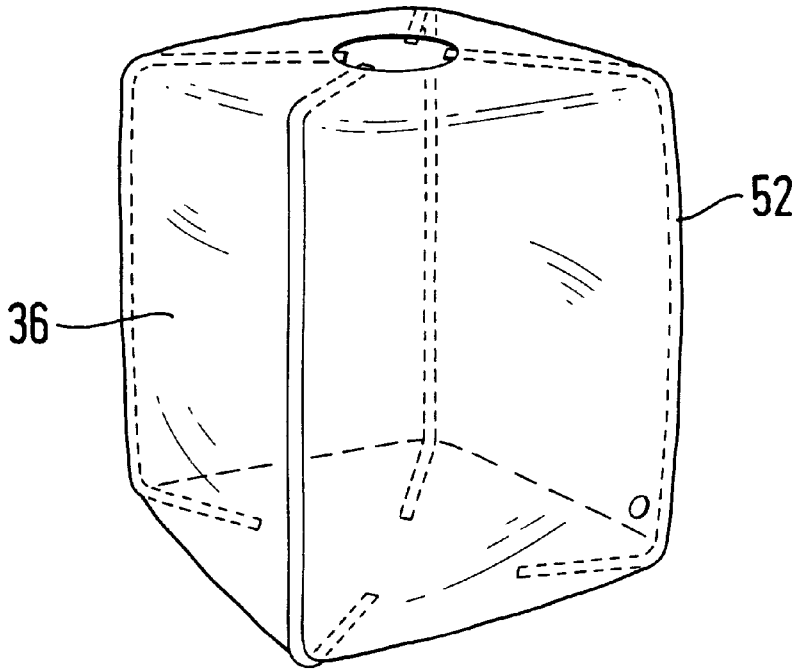
Figure 10B:
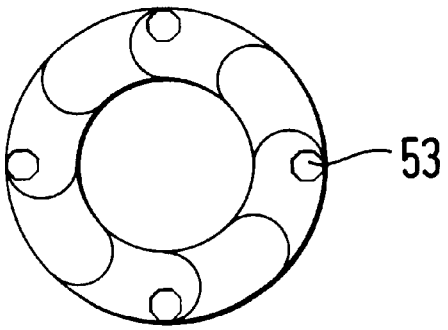

A typical design of the device or funnel according to the invention will now be described in detail, the description being based on the related drawings, in which:

FIG. 1A is a sectional view of the device, mounted with a lining through the bung-hole of a conventional metal oil barrel and ready to insert into a folded bag in the barrel, and in addition a loose lid which is intended to replace the conventional bung-hole of such an oil barrel, FIG. 1B illustrates the funnel's bag separately, FIG. 1C shows details of the lining's neck section for ensuring cut-off after screwing in, FIG. 2 illustrates the top part of a screwed-in bung-hole in a standard oil barrel, FIG. 3 is a perspective view of a typical oil barrel with bung-hole and ventilation hole, FIG. 4 is a perspective view of the bottom part of a modified supply pipe for filling of, e.g., oil, and with longitudinal slots in different widths for a specific distribution of, e.g., oil over the circumference of the pipe, FIG. 5 illustrates how oil, e.g., is distributed outwards in the barrel from the slots in the supply pipe, FIG. 6 illustrates the top part of the supply pipe mounted in a filling machine, FIG. 7 illustrates the supply pipe in its lowest position and its push rod with closing/push piston also in its lowest position, protruding in relation to the supply pipe and not in the bottom member of the device at the bottom of the barrel, FIG. 8 is a section indicated by A—A in FIG. 7 of a guide element for guiding the push rod inside the supply pipe, FIG. 9 illustrates an alternative design of the bottom member, FIG. 10A illustrates a bag specially intended for IBC containers, where the bag is equipped with stiffening bodies, and FIG. 10B illustrates air channels for arrangement in the holder, intended for filling the stiffening bodies with air.

Thus FIG. 1 illustrates a typical design of the invention's device which is described here as an insertion pipe or funnel 1, with a holder 2 which has a screw lid 4 at the top with a central lid opening 6. The lid opening corresponds to the bung-hole 10 of a standard oil barrel, but has a slightly smaller diameter. Through the lid opening 6 there is passed a sleeve 12 which envelops a supply pipe 14 and closes the annular opening which is formed between it and the internal threads in the lid opening. The sleeve can slide axially both in relation to the lid opening and the supply pipe. In a variation, however, the sleeve can be considerably shorter and more in the shape of a disc with a short central hole flange. The sleeve 12 helps to prevent air being drawn into the funnel's 1 inserted bag 36 when it is pushed into a container such as an oil barrel 8 before filling.

The supply pipe 14 is specially designed for the invention, in the form of a modified standard pipe—often called a lance—and associated with a suitable filling machine, e.g. of type 29, 29.1 or 29.2 from Feige GmbH. In a sealable area near its lower end the modified supply pipe has longitudinal openings in the form of slots 16, or alternatively at least one of them can be tapering upwards or differently designed, possibly also being provided with at least one hole. The object of the openings is to distribute the fluid or the oil in an appropriate manner during the filling of the bag 36, thus ensuring that it expands gradually inside the oil barrel 8 or the like without the simultaneous supply of a substantial amount of air, finally forming an insulating and sealing liner therein, this being called insulated filling in this context.

In the centre of the supply pipe 14 there is provided a push rod 18 which can be moved axially in the pipe and has a closing/push piston 20 at the bottom whose combined function is to seal the lower part of the supply pipe 14 when filling is not in progress, or in a protruding position to guide the bottom 37 of the bag 36 down to the bottom of the barrel 8 by means of a cup-shaped bottom member 22, after the latter has first been forced out of its position inside a lining 24. The closing/push piston 20 is rounded at the bottom to enable it to be centred in both the holder's 2 lower part which forms a neck section 38, and the top part of the bottom member 22. The lining has a neck section 35 with an upper opening 29 and a lower opening 31 and is screwed into the oil barrel's 8 bung-hole 10 where it will be permanently located, i.e. until the barrel is emptied and a new filling procedure has to be performed, when a complete new funnel 1 is screwed in instead of the lining 24. The latter is removed for material recycling, or reuse. A bead 28 at the top of the bottom member 22 fits into a ring groove 30 in the lining 24 and holds the bottom member in position before it is pressed down, but nevertheless without preventing the closing/push piston 20 from releasing it when a moderate pressure is exerted on the bottom 32 of the bottom member. Longitudinal slots 34 in the bottom member facilitate the release by allowing the sleeve walls between the slots to spring inwards in their top section. Alternatively, the bottom member 22' can be designed as illustrated in FIG. 9, with an external gradation 25 and a conical internal cavity 33. In such a design it is only the top part which is expandable to a limited extent. In this case the closing/push piston is similarly conically shaped in its bottom section.

The neck section 35 of the lining 24 is curved outwards, forming an external hexagonal nut flange 42 which is split up into several, e.g. three parts with slots 53. When they are three in number as shown in FIG. 1C, the slots 53 have an angle distance of 120° and extend from the circumference of the nut flange to a 360° fracture zone 54, The width of the slots 53 should be minimal, thus enabling the intermediate parts to come as close to one another as possible in order to be able to transfer torque from a hexagon spanner which fits and also can be lifted up to a nut member 44 at the bottom of the neck section 29 on the holder 2. The fracture zone 54 is ruptured from the neck section 35 by a predetermined torque on the hexagon spanner, e.g. 10–30 Nm, splitting up the nut flange 42 into three separate parts.

In a version which is intended for a container with the filling opening or bung-hole at the top, but without an outlet opening at the bottom, the devices or the funnel's 1 bag 36 is illustrated separately and in a folded state in FIG. 1B and is indicated inserted into the holder 2 in FIG. 1A. In this case the bag has its single opening, the filling opening, at the bottom where it is secured by refolding on to the lining 24 in such a manner that from the outermost neck section of the bag there is formed an end piece 39 which is turned inside out on the outside of the lining and clamped into it by, e.g., a shrunk-on sleeve 41 (a shrink stocking). The bag is filled on "the outside", part of its bottom 37—which is thus basically at the top—having already been pushed down and in through the bag when the funnel was mounted, down to the height of the end piece 39 and enclosing the bottom part 22 inside the lining. Before filling, the bottom of the bag is then passed together with the bottom member right down to the bottom of the oil barrel 8 by means of the supply pipe's push rod. Thus the bag is already reversed inwards from the bottom side in the prepared funnel, thus forming a mouth or "opening" 23 at the top. Not until the product concerned such as oil has to be filled are the sleeve 12 and the supply pipe 14 passed down into the lid opening 6 and the opening 23, thereby preventing the admixture of foreign bodies. A lid 19 with a slightly smaller diameter than the barrel's 8 conventional bung-hole 26 (illustrated in FIG. 2) closes the holder 2 to begin with. The bag 36 is adapted to the shape of the barrel's internal volume and in the opening and neck section can be passed out though a relatively narrow end piece 39, as illustrated in FIGS. 1A and 1B. The end piece is passed through a lower neck section 38 on the holder 2, down through the lining 24 on the inside and up again on the outside where it is clamped between it and the external shrink sleeve 41.

In the curved area at the base of the bag's end piece 39 the bag foil can also be arranged in a double fold 27 which is passed up into a clamping slot 40 which extends axially in the lining's 24 bottom wall part. The actual bag bottom 38 can be welded to the underside of the bottom 32 and also be protected by fitting on a plastic adhesive slot, indicated by broken lines in FIG. 1A.

Since the bung-hole 10 on a conventional oil barrel 8 of metal is located right out at the edge on one side of the top surface, the bag 36 should preferably be preshaped in an unsymmetrical form, so that its opening and end piece 39 are also on one side. However, if a sufficiently strong, but deformable foil material is chosen for the bag, the end piece and the opening area do not need to be preshaped when the bag is manufactured, but can be formed by stretching while being bent around the lower end of the lining.

The holder 2 can also be unsymmetrical in order to provide more space for the bag material on one side. The manner in which the bag 36 is folded in the holder is such that its bottom can be pushed unimpededly in and down together with the closing/push piston. In order to facilitate the downward pulling or pushing, an upwardly projecting partition wall with a rounded top can be provided in some way (not shown), and the folding of the bag can be performed in a manner which corresponds to that in which a parachute is folded. In order to avoid the neck section of the bag and the end piece 39 rubbing against the internal threads in the lining 24 during mounting in the lining, the holder 2 is first screwed into the upper opening 29 of the lining.

The embodiments which are illustrated in FIGS. 1–9 illustrate the use of the invention in connection with oil barrels or other small containers. In the case of IBC containers, which are rectangular in shape to a certain height, it can be expedient to employ supplementary means for distributing the bag in the inside of the container. Such containers normally also have an outlet on the side, with the result that it is desirable to employ extra means for arranging the bag in the correct position, with the bag's outlet opening at the container's outlet opening.

For this purpose the bag 36 can be equipped with, e.g., four flexible air hoses which are mounted on the bag in its corner areas. A design of this kind is illustrated in FIG. 2A, where these hoses are indicated by 25. When these hoses or tubular, flexible bodies are filled with air, the bag will be stiffened, thereby assuming a shape in which the bag partially fills the container's internal space. When the container is "prefilled" in this manner it may be necessary to release air from the inside of the container, a procedure which will not affect the subsequent filling of the container with fluids or material. For this purpose the central filling opening can be equipped with an annular body as illustrated in FIG. 10B, which will be inserted in the area of the lining's 24 upper opening 29. In the outer ring there can be paths for through-flow of air from the inside of the container. In the same area there are provided air channels 53 which can be supplied with compressed air for inflating the tubular stiffening bodies 52 in the bag. The lining is then inserted into the central area in the conventional manner The use of the invention will now be explained, reference again being made to the FIGS. 1–9, and where the filling of a conventional oil barrel is employed as an example.

An oil barrel which has to be filled with oil is conveyed into a filling plant and preferably fully automatically into a filling machine, e.g. with a filling member, as indicated in FIG. 6, and also conveyed to the filling machine is the invention's device in the form of a closed funnel with a bag in position for mounting. The oil barrel's 8 original bung-hole 26 has been removed beforehand and is replaced by the funnel's lining 24 before filling. The lid 19 on the funnel's screw lid 4 is screwed on until immediately before the filling is performed, in order to prevent anything from entering the funnel and its bag. As mentioned, the bag's holder 2 has a nut member 44 at the bottom of its neck section 38, and on its corresponding neck section the lining 24 has the nut flange 4 with the same width across flats as the nut member. A hexagon spanner which is located around the nut flange can thereby be lifted up and grip around both the nut flange and the nut member 44 above, or only the latter.

The funnel is mounted by first passing such a hexagon spanner into the neck sections 35 and 38, and the holder is screwed into the lining 24 in the bung-hole 10 by the spanner gripping the nut member 44 and screwing it into the innermost thread to a position where a mark such as an arrow 45 indicates the closest edge of the barrel 8. An arrow 43 on the nut flange 42 may also point to this edge. The nut member 44 and thereby the holder 2 will indicate by means of its arrow 45 a predetermined position in relation to the out flange and the lining 24 before and during the mounting, with the object of guiding the bag's 36 main part down on the side of the bung-hole 10 which faces outwards in the barrel. Finally, the bottom member should also have a mark such as an arrow 47 which indicates the correct angular position in relation to the lining. An arrow, a colour mark or in general a machine readable mark with a view to full automation can be placed at each of the above-mentioned points, so that all three arrows or marks are axially aligned when the device is screwed into the barrel. A packing 49 is inserted between the lining 's outwardly projecting flange and the bung-hole's 10 top contact surface, thus achieving a kind of seal even though the lining is not screwed in further than a maximum of, e.g., 270° from its absolutely most tightened position.

The spanner is retained around the neck sections 35, 38 during filling.

After the closed funnel 1 has been mounted, the holder's lid 19 is unscrewed. It is essential that the environment in and around the filling machine should be subject to suitable criteria in order to avoid contamination from impurities. The lid 19 which covers the holder to begin with is taken care of, since after filling it has to be used to close the threaded upper opening 29 of the lining 24, mounted for its part for lining the bung-hole 10 until a new funnel has to be mounted.

At first the supply pipe 14 can be somewhat withdrawn in relation to the bottom part of the sleeve 12. However, FIG. 1 illustrates the supply pipe in a slightly protruding position in relation to the sleeve and with its internal push rod 18 pushed even further forward. The push rod is held centrally in position in the supply pipe 14 by means of guiding elements 46, 46' (FIG. 8) which form an outer and an inner ring and between the rings two or more spokes with large intermediate openings in order to permit fluid to pass almost unimpeded.

The uppermost of the guiding elements illustrated in FIG. 8 is indicated by 46' and one of its spokes is designed fairly wide with a hollow which causes a fluid flow which comes from above to be deflected and forced out to the side, approximately horizontally or in fact sloping slightly upwards This causes the deflected jet to assist in pushing the main part of the bag 36 out and slightly upwards, whereby it more easily fits closely against the barrel wall.

An alternative to this kind of sideways and upwardly directed jet deflection is indicated in FIG. 1A by a curved pipe connection 50 which will also convey fluid out to the side and slightly upwards. This pipe connection 50, however, is attached to the push rod 18 and will only be effective when it is passed so far down that the end piece with its outlet opening 50' comes outside one of the slots 16, preferably the widest.

Another alternative is indicated in FIG. 6, where the bottom of the supply pipe 14 completely surrounds the push rod 18 while at the same time having an internal guide vane 52 for guiding the fluid out into the widest of the slots 16.

The bottom 37 of the bag 36 is brought down into the barrel 8 by first pushing the push rod 18 with the closing/push piston 20 downwards into the bag tunnel which is formed from the opening 23 and down to the interior of the bottom member 22, whereupon the piston together with the bottom member and the surrounding original top part of the bag are passed right down to the bottom of the barrel. During this operation the main part of the folded bag is also continuously pulled downwards from the inside and will remain lying substantially on one side of the supply pipe 14, viz. in order to most effectively fill the volume of the barrel therefrom. The bag is passed downwards while being turned inside out without the supply of any substantial amount of air, the bag material being pulled in towards the sleeve and following the outside thereof and the supply pipe. The bag is thereby kept almost in an evacuated state before filling. At the same time as the push rod 18 is advanced, the supply pipe 14 is passed down to the bottom of the barrel, but during this phase the pipe is kept closed by the push rod's piston 20. Not until the rod and the pipe are pulled slightly up or back and when in addition the pipe is pulled up slightly in relation to the piston is the barrel opened for the supply of oil. The barrel's 8 ventilation hole 48 (FIG. 3) is then opened to release the surrounding air.

FIG. 4 illustrates the bottom part of the supply pipe 14 with longitudinal slots 16, and it is apparent that the slots are widest on one side, viz. the side which has to face inwards in the barrel, in order to provide a more powerful flow of oil in this direction. FIG. 5 indicates how the oil flow can be distributed from the supply pipe, 60%, e.g., being passed right out into the barrel (indicated by the largest of the arrows), while the remaining 40% can be distributed approximately as indicated by progressively smaller arrows around the circumference of the supply pipe.

During filling the supply pipe is preferably pulled up gradually, thus retaining the slots 16 in the area of the oil surface all the time. The push rod and the closing/push piston 20 are simultaneously pulled up during fillings while the bottom member remains lying on the bottom. Magnets can be inserted on the underside of the bottom member 22 in order to hold it down on the bottom of an oil barrel of sheet iron. Alternatively, the bottom member can be pulled up together with the closing/push piston, e.g., by providing a releasable grip ring 51 at the bottom of the piston. This alternative permits the entire funnel with lining and bottom member to be unscrewed instead of what is indicated above, and enables it to be reused in the continuous production, with a new bag inserted.

When the filling is approaching its final phase, determined by the gross weight approaching its final value, the lining and the closing/push piston can be pulled further up in the supply pipe, gradually choking the slots and finally completely closing the pipe, until a new barrel has to be filled.

At B in FIG. 6 a point is indicated where the supply pipe at the top of the filling machine can be opened via a discharge valve in order to allow the oil which remains in the pipe to be released downwards after the main supply indicated by the branch pipe on the right of the figure has been closed off by a ball valve. The ball valve and the discharge valve are generally pneumatically controlled and form part of the filling machinery's control system, together with the movement control of both push rod and supply pipe. A practical control system can be provided in a known per se manner with the object of ensuring the fastest possible filling of oil, gradual reduction of the oil supply when the gross weight approaches its final value, and prevention of oil spillage in the final part of the filling cycle until a new oil barrel is in place under the supply pipe.

With the use of appropriate, e.g. pneumatic, filling machinery, the entire operation can be conducted in the course of a fairly short time and completely automatically (robot operation). A test model with partially manual operation has 30–45 seconds as a realistic objective, but fully automatic production is planned where the complete cycle time is reduced to a half of this.

I claim:

1. A device for insulated filling of a container (8) comprising:

a holder (2) with a top part (4) incorporating an upper opening (6), in which bolder (2) is positioned a folded bag (36) with one or two openings, the bag being arranged for insertion in the container (8) and in expanded state forming an insulating lining in the container (8), at least one closing device (12,19), to keep the holder (2) and the bag (36) closed, and a movable supply pipe (14), insertable in the opening (6), adapted for filling fluid or material into the bag (36) after it has been inserted into the container (8), thus enabling the container to be filled, without fluid or material coming into contact with the container's internal walls, characterized in that the device further comprises:

a lining (24) with an upper and a lower opening (29,31) arranged for insertion into an upper opening (10) in the container (8), a bottom member (12) which is removably attached inside the lining (24) and is surrounded by one end of the bag, the bottom (37) of the bag, while the other end of the bag, the bag's filling opening is passed between the bottom member (22) and the lining (24), round the lining (24) to the outside thereof and attached in this position, a push rod (18) provided in the supply pipe (14) with a closing/push piston body (20) capable of closing the supply pipe (14), for pushing the bottom member (22) with the bottom end (37) of the bag (36) down to the bottom of the container (8) and simultaneously the folded main part of the bag (36) and the supply pipe (14) into the container (8), the supply pipe (14) being provided with means for controlled, directional outflow (FIG. 5) of fluid/filling material, the supply pipe (14) during the filing operation being movable between a position near the container bottom and the position at the container top, the device preferably being provided with means for outlet of air from a space between the container walls and the bag.

2. A device according to claim 1, characterized in that the push rod (18) with the closing/push piston body (20) is arranged centrally in the supply pipe (14), the bottom member (22) being at least partially expandable, the bottom (37) of the bag (36) being turned inside out in the main part of the bag with the bag's filling opening at the bottom and attached by clamping to the outside of the lining (24), which filling opening of the bag is provided with a section which forms an end piece (39).

3. A device according to claim 2, characterized in that the supply pipe (14) is provided at its upper area with a guide element (46, 46') which envelops the push rod (18) and is connected at the bottom to a pipe connection or guide vane (50, 52) in order to cause a latterally directed and partially backwardly sloping fluid deflection.

4. A device according to claim 1, characterized in that the lining (24) is provided with a threaded neck section (35) fitting into the container opening (10) and that the closing device of the holder (2) comprises a lid (19) which fits both the upper opening (6) at the top of the holder (2) and the upper opening (29) in the neck section (35) of the lining (24).

5. A device according to claim 1, characterized in that the bag's (36) filling opening (23) with a section forming an end piece (39) are provided at one side of the bag in order to correspond to the position of the bung-hole of a conventional oil barrel (28), that the holder (2) also is asymmetrical in relation to its upper opening (6) and its lower section (38) in order to provide more space for the bag's main part on one side, and that the holder (2), the lining (24) and the bottom member (22) have a marking (43, 45, 47) on the side, to indicate the correct position in relation to one another and to a specific point on the top of the container (8).

6. A device according to claim 1, characterized in that the closing device (12,19) further comprises a sleeve (12) against which the outside of the supply pipe (14) is slidable and which is adapted to a space in the lid opening outside the pipe (14), corresponding to the thickness of the lower section (38) of the holder (2) and that the holder (2) with it's lower section (38) are arranged to be screwed into the lining's corresponding neck section (35).

7. A device according to claim 6, characterized in that the sleeve (12) is provided with a pipe flange for surrounding the supply pipe (14).

8. A device according to claim 1, characterized in that a bag's end piece (39) near the end which faces away from the filling opening (23) has an outwardly formed fold (27) arranged to clamped, for attachment in a corresponding clamping slot (40) at the bottom of the lining (24).

9. A device according to claim 1, characterized in that the bag (36) is equipped with tubular, flexible stiffening bodies (52), which, when the bag (36) is located inside the container, form a stiffening frame which keeps the bag expanded.

10. A device according to claim 9, characterized in that the tubular stiffening bodies (52) are hollow and are connected to an air source via air channels (53) which are passed through a stiffening flange in the container's filling section.

11. A device according to claim 9, characterized in that the stiffening bodies are made of solid, but elastic plastic.

12. A method for insulated filling of a container (8), which has at least one hole (10) at the top for filling, by use of a device (1) according to claim 1, comprising a holder (2) in which a folded bag (36) is arranged for insertion into the container (8) and in an expanded state to form an insulating lining in the container (8), at least one closing device (12,19) for keeping the holder (2) and the bag (36) closed, and a movable supply pipe (14) for insertion into the container (8), characterized by mounting of the device on the container (8) by screwing a lining (24) with the surrounding bottom part of the bag into a hole (10) of the container (8), positioning of the insulating bag lining in correct position in relation to the top of the container, by positioning a marking on the bag and on the lining (24) in correspondence with a specific point at the top of the container (8), opening the closing device (12,19) of the holder (2) and inserting the supply pipe (14) into the holder (2), the supply pipe (14) being an element in a filling machine, passing down the supply pipe (14) together with an inner, central push rod (18) through the holder (2), until the push rod pushes out a bottom member (22) which is positioned in the lining (24) and is enveloped by the bottom part (37) of the bag (36), the bottom part (37) having previously been pushed into the bag's main part from the top, passing down the bottom member (22) together with the surrounding bottom of the bag (37) to the bottom of the container (8), whereby the inflow of air through the supply pipe (14) to the bag is limited to a minimum, as the supply pipe (14) is kept close by the push rod's closing/push piston (20), the main part of the bag thus being in an approximately evacuated state pulled down into the container, pulling up on a limited range the supply pipe (14) in relation to the push rod and closing/push piston (20) thereby opening windows (16) in the supply pipe (14) and starting the filling of the product concerned while the supply pipe is gradually pulled up, until the filling of the container is almost complete, the push rod and the closing/push piston (20) then being pulled up and into the supply pipe (14) closing the windows, pulling up the supply pipe/push rod from the device's holder (2), unscrewing the holder (2) from the lining (24), closing the container (8) by screwing a lid (19) into the lining (24) and that during the insertion of the bag and the filling operation, the air residing between the bag (36) and the container's (8) walls is removed through an additional opening in the container (8) or outlet means in the area of the container's filling hole (10).

13. A method according to claim 12, characterized by introducing compressed air into the bag's (36) stiffening hoses before and/or during filling of the product concerned.

* * * * *